US006383126B1

(12) United States Patent
Fondin

(10) Patent No.: US 6,383,126 B1
(45) Date of Patent: May 7, 2002

(54) ROTOR-TYPE CENTRIFUGE WITH A LID PRESENCE CHECKING ARRANGEMENT

(75) Inventor: Jean Louis Fondin, Saint Nazaire (FR)

(73) Assignee: Jouan (FR)

( * ) Notice: Subject to any disclaimer, the term of this patent is extended or adjusted under 35 U.S.C. 154(b) by 0 days.

(21) Appl. No.: 09/679,644

(22) Filed: Oct. 5, 2000

(30) Foreign Application Priority Data

Oct. 8, 1999 (FR) ..... 99 12580

(51) Int. Cl.[7] ..... B04B 13/00
(52) U.S. Cl. ..... 494/7; 494/10; 494/12
(58) Field of Search ..... 494/1, 7, 9, 10, 494/11, 12, 16, 20, 34, 84

(56) References Cited

U.S. PATENT DOCUMENTS 2,779,537 A * 1/1957 Madany
3,970,245 A * 7/1976 Aeschlimann
4,342,419 A 8/1982 Conway
4,464,161 A 8/1984 Uchida et al.
4,772,254 A * 9/1988 Grassl et al.
5,037,371 A * 8/1991 Romanauskas
5,221,250 A * 6/1993 Cheng
5,235,864 A * 8/1993 Rosselli et al.
5,382,218 A * 1/1995 Uchida
5,649,893 A * 7/1997 Inaniwa et al.
5,871,435 A * 2/1999 Numata et al.

FOREIGN PATENT DOCUMENTS

WO WO 96/01697 1/1996

* cited by examiner

*Primary Examiner*—Charles E. Cooley
(74) *Attorney, Agent, or Firm*—Larson & Taylor, PLC

(57) ABSTRACT

This centrifuge comprises a rotor, with at least one housing to hold a product for centrifuging and an associated lid to close the housing, the centrifuge also comprising a motor on which the rotor is mounted to rotate about an axis of rotation. It also comprises a mechanism for checking for the presence, on each housing, of the associated lid in order to prevent the execution of a cycle of centrifugation if the lid of a housing is absent.

18 Claims, 2 Drawing Sheets

ROTOR-TYPE CENTRIFUGE WITH A LID PRESENCE CHECKING ARRANGEMENT

FIELD OF THE INVENTION

The present invention relates to a centrifuge of the type comprising a rotor with at least one housing to hold a product for centrifuging and an associated lid to close the said housing, the centrifuge also comprising a motor on which the rotor is mounted to rotate about an axis of rotation.

The invention applies, for example to the centrifuging of biological products.

BACKGROUND OF THE INVENTION

For centrifuging such products, it is usual to employ receptacles containing the products to be centrifuged in the housings of the rotor. Each housing is then sealed hermetically with its associated lid.

The use of lids is particularly important when centrifuging dangerous biological products because if the receptacles containing such products are open, or if they break, centrifugation will give rise to an aerosol which would act as a vehicle for dangerous substances.

The use of lids also enables such an aerosol to be confined within the housings.

If a closure lid for a housing is absent during centrifugation, the aerosol will be diffused and may be deposited inside the enclosure of the centrifuge in which the rotor is arranged.

This situation is especially hazardous for operators who could inhale the aerosol on opening the enclosure of the centrifuge, or who could be contaminated by the aerosol deposited on the walls of the enclosure or on the rotor.

SUMMARY OF THE INVENTION

It is an object of the invention to solve this problem by providing a centrifuge of the abovementioned type that limits the risks associated with centrifugation on a rotor in which a housing is not closed by its lid.

To this end, the subject of the invention is a centrifuge of the abovementioned type, characterized in that it comprises means of checking for the presence, on each housing, of the associated lid in order to prevent the execution of a cycle of centrifugation if the lid of a housing is absent.

In accordance with certain particular embodiments, the centrifuge may comprise one or more of the following characteristics, taken in isolation or in all technically possible combinations:

- the said checking means comprise at least one element to be detected on each lid and at least one corresponding sensor,
- the centrifuge comprises a motor control unit designed to carry out a step of checking for the presence on each housing of the associated lid, in the course of which step the said unit causes the rotor to be rotated, compares the number of element(s) detected with the total number of element(s) that would be detected if each lid were present, and prevents the execution of a cycle of centrifugation if the number of element(s) detected is less than the total number of element(s) that should be detected,
- the control unit is designed to carry out the check step before executing each cycle of centrifugation of the rotor,
- during the said check step, the control unit causes the rotor to be rotated at a speed at which there is no risk of formation of aerosol,

- the centrifuge comprises means of detecting the type of rotor mounted on the motor, and the control unit is designed to determine the total number of element(s) to be detected on the basis of the type of rotor detected,
- the control unit comprises memory means in which is stored a total fixed number of element(s) to be detected whatever the type of rotor mounted on the motor,
- the said checking means comprise several sensors arranged at different distances from the axis of rotation,
- several of the said sensors are arranged at different levels relative to the axis of rotation,
- each element to be detected is a magnet.

Also within the invention is an assembly comprising a centrifuge as defined above and several rotors that can be mounted on the motor of the centrifuge, each rotor having at least one housing to hold a product for centrifuging and an associated lid to close the said housing, characterized in that each rotor comprises the same number of element(s) to be detected.

A clearer understanding of the invention will be gained from a reading of the following description which is provided purely by way of example and refers to the accompanying drawings, in which:

DETAILED DESCRIPTION OF THE PREFERRED EMBODIMENTS

Figure 1:
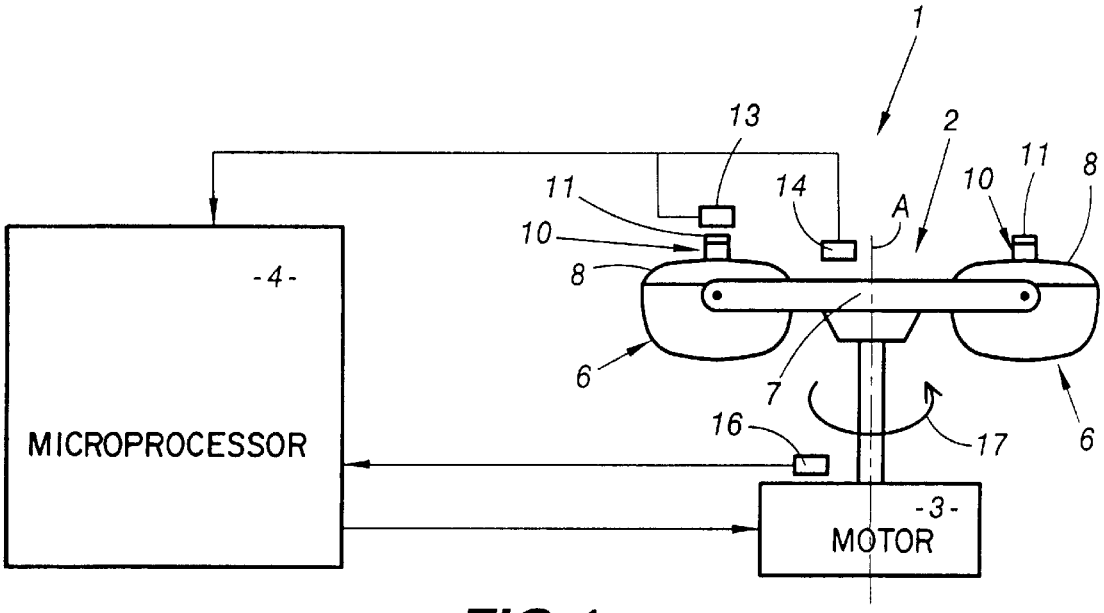
FIG. 1 is a schematic side view of a centrifuge according to the invention.

FIG. 1 is a schematic view of a centrifuge 1 that essentially comprises a rotor 2, an electric motor 3 for rotating the rotor 2 about a vertical axis A, and a microprocessor unit 4 for controlling the motor 3.

The rotor 2, which is mounted on top of the motor 3, comprises two diametrically opposite holders 6 that pivot by means of horizontal spindles on the arms 7 of the rotor 2.

Each holder 6 forms a housing to hold receptacles for a product for centrifuging and comprises a removable closing lid 8.

The lids 8 hermetically seal the housings defined internally by the holders 6.

Figure 2:
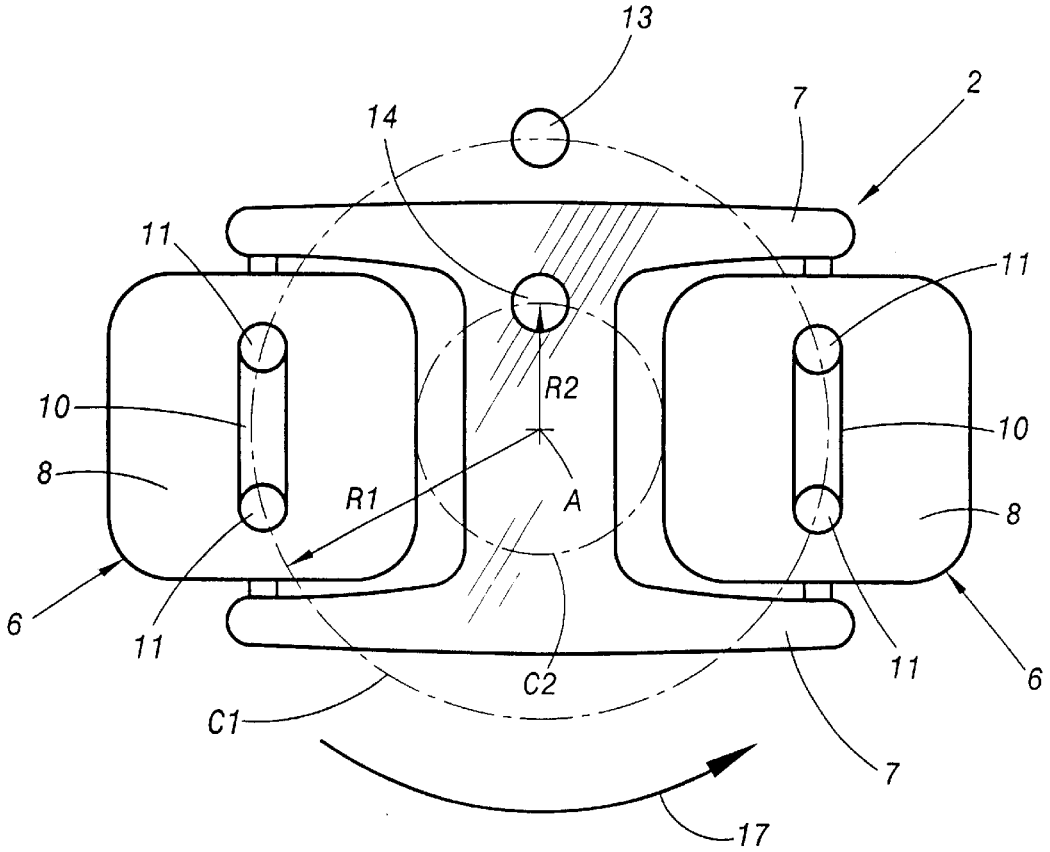
FIG. 2 is an enlarged schematic plan view illustrating the respective radial positions of the rotor and of the sensors of the centrifuge shown in FIG. 1.

In the rest position shown in FIGS. 1 and 2, that is when the rotor 2 is not rotating, the lids 8 sit on top of the remaining portion of the holders 6 and are roughly horizontal.

On top of each lid 18 is a central U-shaped support 10 attached by its base to the lid 8 in question. The free upper ends of the supports 10 each carry a magnet 11. The four magnets 11 are arranged at approximately the same distance R1 from the axis A. The four magnets are thus arranged approximately on a single geometrical circle C1 (FIG. 2) whose center is on the axis A and whose radius is R1.

The centrifuge 1 also includes two magnetoresistive sensors 13 and 14 located above the rotor 2.

The sensor 13 is arranged approximately at the distance R1 from the axis A, as can be seen in FIG. 2, where the angular position of the rotor 2 and of the sensors 13 and 14 has been modified compared with that in FIG. 1 for reasons of clarity.

The sensor 14 is arranged in the same radial direction as the sensor 13, but roughly at a distance R2 from the axis A, where R2<R1. The sensor 14 is also located at a lower level than the sensor 13 relative to the axis A.

The sensors 13 and 14 may, for instance, be supported by the free ends of an inverted U-shaped support, itself supported by the movable lid of an enclosure (not shown) containing the rotor 2.

The control unit 4 is connected to the sensors 13 and 14 and to a sensor 16 that measures the rotation of the rotor 2. The sensor 16 may for example be the sensor usually connected with the output shaft of the motor 3 to measure the speed of rotation of this shaft during the centrifugation cycles performed by the centrifuge 1.

The unit 4 is also connected to the electric motor 3 to control it and carry out cycles of centrifugation of products placed in the holders 6.

The unit 4 is programmed among other things to carry out, before any centrifugation cycle, an initial step to check for the presence of the lids 8, which step will now be described.

As the arrow 17 shows in FIGS. 1 and 2, the unit 4 causes the rotor 2 to rotate for e.g. two revolutions at a speed of less than 50 rpm, and preferably at a speed of between 20 and 30 rpm. At this slow speed of rotation the holders 6 stay more or less in their positions shown in FIGS. 1 and 2, and there is no danger of aerosol forming.

After two revolutions of the rotor 2 brought about by signals sent from the control unit 4 to the sensor 16, the unit 4 compares the number of magnets 11 detected by the sensor 13.

If the signals received from the sensor 13 correspond to eight magnets 11 having passed it, in other words if the two lids 8 are on top of the holders 6, the unit 4 commands the desired centrifugation cycle to be carried out.

If the signals do not so correspond, the unit 4 stops the motor 3 and the centrifugation cycle is not carried out. This corresponds to the absence of at least one lid 8. The operator must then close the corresponding holder or holders 6.

The check step described above will then be performed once again until the two lids 8 are detected by the sensor 13, in which case the desired centrifugation cycle will then be carried out.

Figure 3:
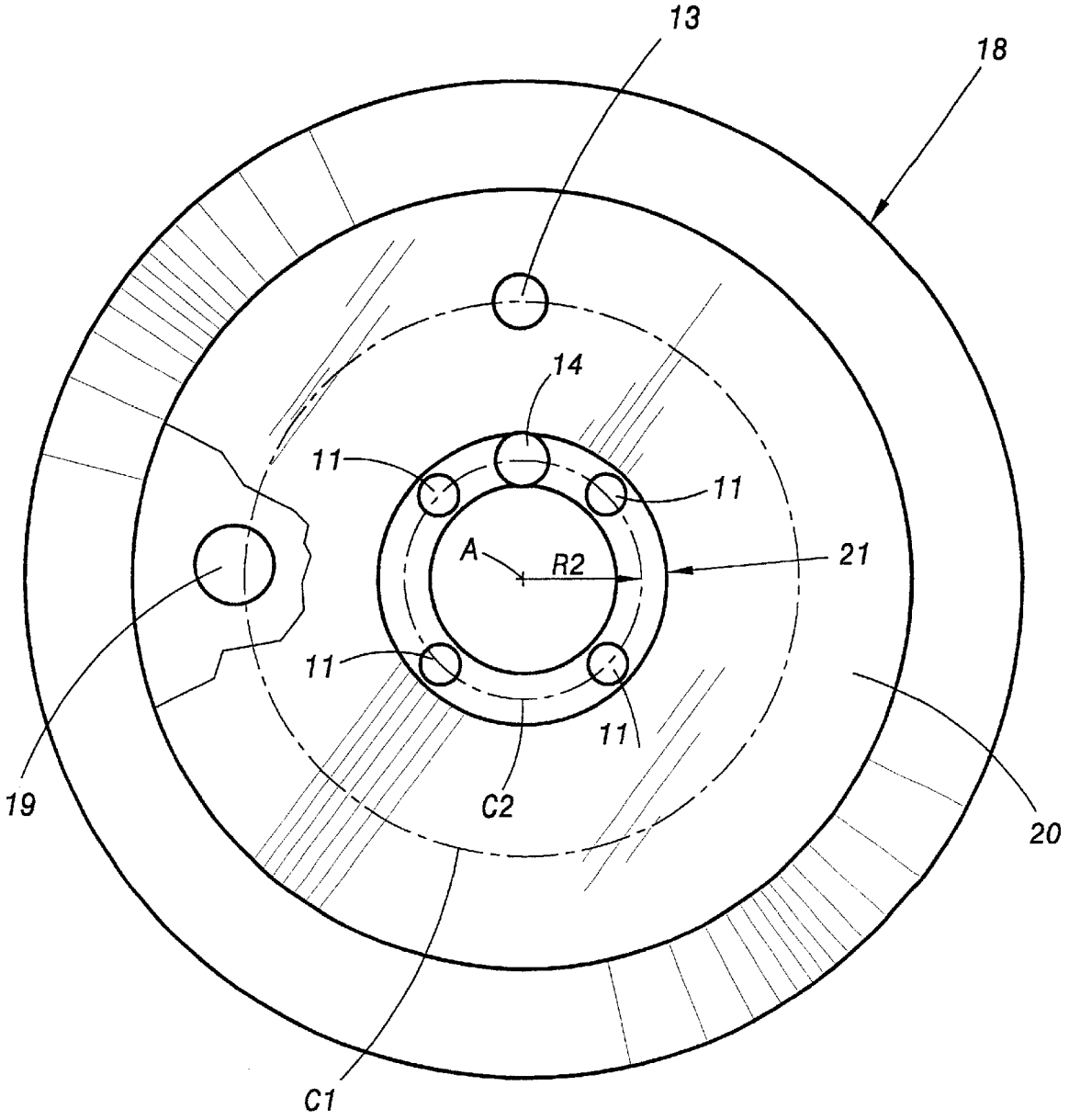
FIG. 3 is a view similar to FIG. 2, with parts cut away, illustrating the use in the centrifuge of FIG. 1 of another type of rotor.

FIG. 3 illustrates the centrifuge of FIG. 1 in which the rotor 2 with holders 6 has been replaced by a rotor 18 of upwardly converging frustoconical general shape.

The rotor 18 has several housing 19 for ampoules or other receptacles designed to contain products for centrifuging. One housing 19 can be seen at the cut-away part of FIG. 3.

However, in a variant, different types of rotors may be equipped with a different number of magnets. The centrifuge 1 is then preferably equipped with means for detecting the type of rotor mounted on the motor 3, so as to determine the number of magnets 11 to be detected in each revolution of the rotor, during the initial step of checking for the presence of the lid or lids.

When a centrifugation cycle is to be carried out, the control unit 4 performs, as before, an initial step to check for the presence of the lid 20.

If the number of magnets 11 detected by the sensor 14 in the course of two revolutions of the rotor 18 is less than eight, the control unit 4 stops the motor 3. Otherwise the centrifugation cycle is carried out as normal.

The centrifuge 1 thus limits the risk of centrifugation of a rotor in the absence of a closing lid on a housing containing product for centrifugation.

All the rotors usable with the centrifuge 1 are preferably provided with four magnets, or more generally with the same number of magnets, in order to simplify the algorithm programmed into the microprocessor of the control unit 4.

The rotor 18 is surmounted by a single lid 20 which is used to close the housings 19. The lid 20 is itself surmounted by a central ring 21 supporting four magnets 11. These magnets 11 are distributed at regular angular intervals and are located substantially on, a circle C2 of radius R2 centered on the axis A.

The disposition of the sensors 13 and 14 at different levels with respect to the axis A ensures that, for the different types of rotors usable with the centrifuge 1, the distance between the magnets 11 to be detected and the sensor 13 or 14 past which they will travel is less than about 30 mm. There is thus little risk that the sensors 13 and 14 will fail to detect a magnet as it passes in front of them.

In a more general way, the number of sensors 13 and 14 may be greater, the sensors being located preferably on circles of varying radii centered on the axis A, and if necessary at different levels with respect to the axis A.

The use of magnetic means 11, 13 and 14 for detecting the presence of a lid or lids allows satisfactory detection even when the rotor is inside a refrigerated enclosure, the functioning of these magnetic detection means being relatively insensitive to condensation which can occur in such an enclosure.

In a variant, the detection means may however by optical or ultrasound means and, more generally, the magnets 11 and the sensors 13 and 14 may be replaced by detectable elements and corresponding sensors, that is to say sensors capable of detecting these elements.

What is claimed is:

1. A centrifuge comprising:

a rotor with at least one housing to hold a product for centrifuging and having an associated lid to close the or each housing, a motor on which the rotor is mounted to rotate about an axis of rotation, checking means for checking for the presence, on each housing, of the associated lid in order to prevent the execution of a cycle of centrifugation if the lid of a housing is absent, said checking means comprising at least one element to be detected on each lid and at least one corresponding sensor, and a control unit constructed to check for the presence on each housing of the associated lid, said control unit comprising means for causing the rotor to be rotated, means for comparing the number of elements detected with the total number of elements that would be detected if each lid were present, and means for preventing the execution of a cycle of centrifugation if the number of elements detected is less than the total number of elements that should be detected.

2. A centrifuge according to claim 1, wherein the checking means includes means for checking before executing each cycle of centrifugation of the rotor for the presence, on each housing, of the associated lid.

3. A centrifuge according to claim 1, wherein the means for causing the rotor to be rotated includes means for causing the rotor to be rotated at a speed at which there is no risk of formation of aerosol.

4. A centrifuge according to claim 1, including means for detecting the type of rotor mounted on the motor, and wherein the control unit includes means for determining the total number of elements to be detected on the basis of the type of rotor detected.

5. A centrifuge according to claim 1, comprising memory means in which is stored a total fixed number of elements to be detected for any type of rotor mounted on the motor.

6. A centrifuge according to claim 1, said checking means comprising several sensors arranged at different distances from the axis of rotation.

7. A centrifuge according to claim 6, wherein several of the said sensors are arranged at different levels in the direction of the axis of rotation.

8. A centrifuge according to claim 1, wherein each element to be detected is a magnet.

9. A centrifuge comprising:

a rotor with at least one housing to hold a product for centrifuging and having an associated lid to close the or each housing, a motor on which the rotor is mounted to rotate about an axis of rotation, checking means for checking for the presence, on each housing, of the associated lid in order to prevent the execution of a cycle of centrifugation if the lid of a housing is absent, said checking means comprising at least one element to be detected on each lid and at least one corresponding sensor, and wherein each element to be detected is a magnet.

10. A centrifuge assembly comprising:

a motor for rotating a rotor about an axis of rotation, a plurality of rotors, each of which is connectable to the motor separately from the other of the plurality of rotors to be rotated by the motor, each of said plurality of rotors having at least one housing to hold a product for centrifuging, an associated lid to close the housing and at least one magnet on each lid, and sensors for detecting each magnet of a rotor connected to the motor to thereby check the presence of each associated lid and prevent the execution of a cycle of centrifugation if the lid of a housing is absent.

11. A centrifuge assembly according to claim 10, wherein each of the plurality of rotors has the same number of magnets as the other of the plurality of rotors.

12. A centrifuge assembly according to claim 10, including a control unit constructed to check for the presence on each housing of the associated lid, said control unit constructed to cause the rotor to be rotated to compare the number of elements detected with this total number of elements that would be detected if each lid were present, and to prevent the execution of a cycle of centrifugation if the number of elements detected is less than the total number of elements that should be detected.

13. A centrifuge assembly according to claim 12, wherein the control unit is constructed to complete the checking before executing each cycle of centrifugation of the rotor.

14. A centrifuge assembly according to claim 12, wherein during checking the control unit is constructed to cause the rotor to be rotated at a speed at which there is no risk of formation of aerosol.

15. A centrifuge assembly according to claim 12, including means for detecting the type of rotor mounted on the motor, and wherein the control unit includes means for determining the total number of elements to be detected on the basis of the type of rotor detected.

16. A centrifuge assembly according to claim 12, wherein the control unit comprises memory means in which is stored a total fixed number of elements to be detected for any type of rotor mounted on the motor.

17. A centrifuge assembly according to claim 10, wherein the sensors are arranged at different distances from the axis of rotation.

18. A centrifuge according to claim 17, wherein several of the said sensors are arranged at different levels in the direction of the axis of rotation.

* * * * *